US006913563B2

(12) United States Patent
Chen

(10) Patent No.: US 6,913,563 B2
(45) Date of Patent: Jul. 5, 2005

(54) LIFTING MECHANISM AND TREADMILL ARRANGEMENT

(76) Inventor: Chao-Chuan Chen, No. 15, Lane 9, Cheng Kung Road, Chin Rong Village, Eu Feng, Taichung (TW), 413

( * ) Notice: Subject to any disclaimer, the term of this patent is extended or adjusted under 35 U.S.C. 154(b) by 269 days.

(21) Appl. No.: 10/337,388

(22) Filed: Jan. 7, 2003

(65) Prior Publication Data

US 2004/0132584 A1 Jul. 8, 2004

(51) Int. Cl.[7] ..... A63B 22/02
(52) U.S. Cl. ..... 482/54
(58) Field of Search ..... 482/51–54

(56) References Cited

U.S. PATENT DOCUMENTS 5,378,212 A * 1/1995 Pin-Kuo ..... 482/54
6,015,368 A * 1/2000 Clem et al. ..... 482/54
6,050,923 A * 4/2000 Yu ..... 482/54
6,461,275 B1 * 10/2002 Wang et al. ..... 482/8
6,592,496 B1 * 7/2003 Tsou ..... 482/54
6,695,751 B1 * 2/2004 Hsu ..... 482/54
6,726,602 B2 * 4/2004 Chang ..... 482/54

* cited by examiner

*Primary Examiner*—Gregory L. Huson
*Assistant Examiner*—Tam Nguyen
(74) *Attorney, Agent, or Firm*—Bacon & Thomas

(57) ABSTRACT

A lifting mechanism and treadmill arrangement is constructed to include a base frame having a horizontal guide frame, a treadmill base, two links bilaterally mounted on the base frame, and a lifting mechanism mounted between a front side of the treadbase and the base frame and having a push member and an inclining motor controlled to drive the push member to move back and forth along the guide frame so as to adjust the angle of inclination of the treadbase.

5 Claims, 6 Drawing Sheets

LIFTING MECHANISM AND TREADMILL ARRANGEMENT

BACKGROUND OF THE INVENTION

1. Field of the Invention

The present invention relates generally to treadmills, and more specifically to a lifting mechanism and treadmill arrangement.

2. Description of the Related Art

A conventional treadmill, as shown in FIG. 1, is generally composed of a base frame 1, a treadbase 2 mounted pivotally on the base frame 1, a first motor drive (not shown) located on the treadbase 2 at a front side thereof and adapted to rotate a belt (not shown), a second motor drive 3, a screw rod 4 coupled to the front side of the treadbase 2 and driven by the second motor drive 3 to lift or lower the treadbase 2 so as to adjust the inclination of the treadbase 2.

The screw rod 4 has a bottom end threaded into an internally threaded barrel 5, which is fixedly located on the base frame 1 at an end thereof. When the second motor drive 3 is operated, the screw rod is 4 screwed into or out of the barrel 5, thereby lifting or lowering the treadbase 2. However, the treadmill is still defective structurally and includes disadvantages as follows:

1. Because the screw rod 4 and the barrel 5 are adapted to move oppositely in vertical direction, the second motor drive 3, the screw rod 4, and the barrel 5 must be located on the middle section of the treadmill to prevent from unbalance of lifting. This limitation confines the available installation space and orientation for the first motor drive.

2. In order to install the first motor drive in the limited space between the treadbase 2 and the second motor drive 3, the first motor drive must be provided with an expensive model of high capacity and small size.

3.Because the second motor drive 3 and the barrel 5 occupy much vertical installation space, the treadbase 2 cannot be set in a horizontal position. As shown in FIG. 1, the treadbase 2 is positioned with a front end thereof lifted and slopes downwardly backwards at an angle. Many consumers may not like to do exercise on an inclined treadbase.

SUMMARY OF THE INVENTION

It is the primary objective of the present invention to provide a lifting mechanism and treadmill arrangement, which is compact and requires less installation space.

It is the secondary objective of the present invention to provide a lifting mechanism and treadmill arrangement, which lifts/lowers the treadbase stably.

To achieve the foregoing objectives of the present invention, the lifting mechanism and treadmill arrangement of the present invention includes a base frame positioned on the floor horizontally, the base frame having a guide frame; a treadbase formed of a treadbase frame and an endless belt; two links bilaterally mounted on the treadbase frame, the links each having a first coupling end and a second coupling end, the first coupling end being mounted pivotally on a front end of the base to form a first pivot point, the second coupling end being mounted pivotally on a front end of the treadbase frame to form a second pivot point, the treadbase frame being turned about the first pivot point with respect to the base frame between an operative position and a non-operative position; a treadbase motor fixedly mounted in the front side of the treadbase frame to rotate the endless belt; and a lifting mechanism including a push member and an inclining motor, the push member having stop means at a front end thereof, the inclining motor being mounted pivotally on the treadbase frame and adapted to drive the stop means of the push member to move back and forth along the guide frame of the base frame.

DETAILED DESCRIPTION OF THE INVENTION

Figure 1:
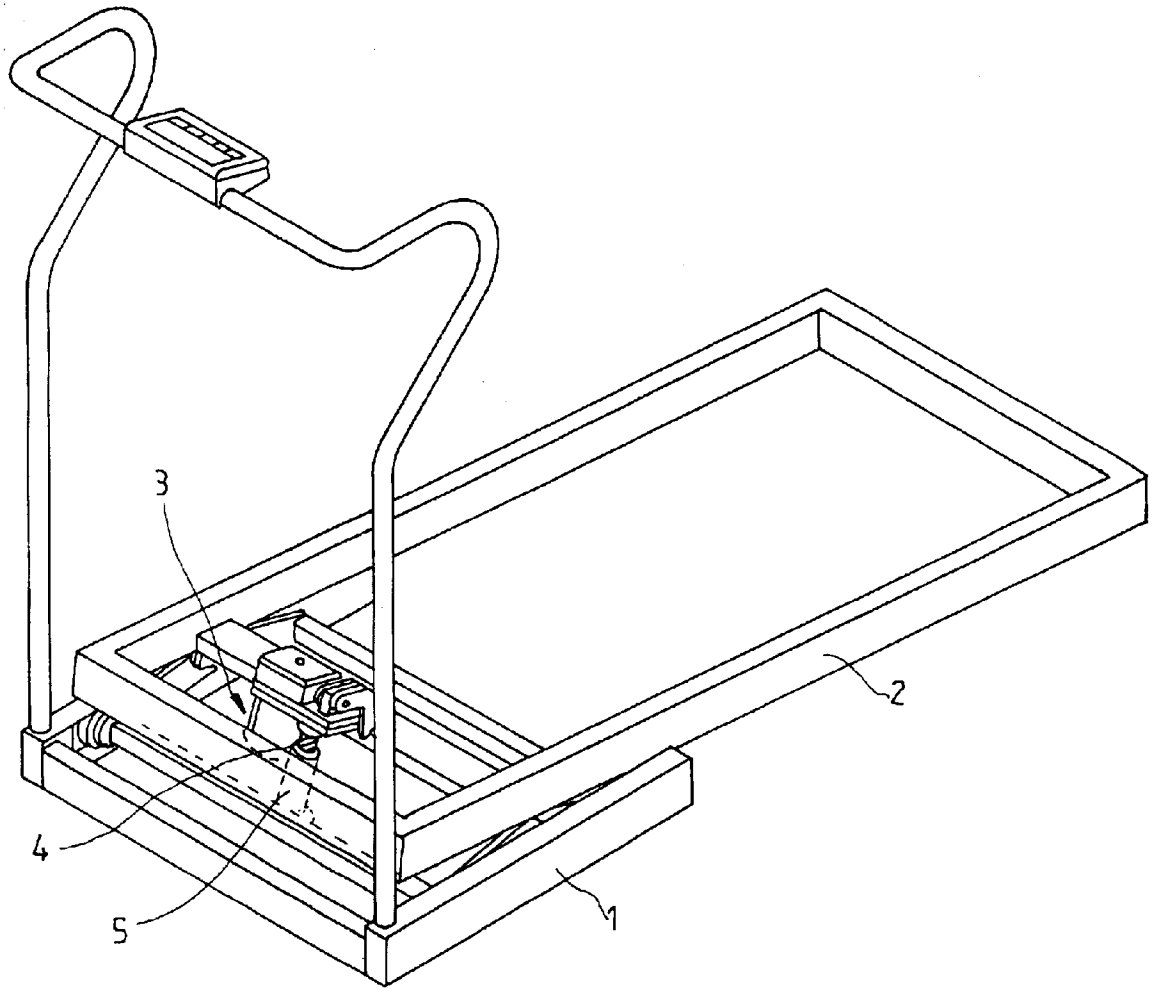
FIG. 1 PRIOR ART
FIG. 1 is a perspective view of a treadmill constructed according to the prior art.
Figure 2:
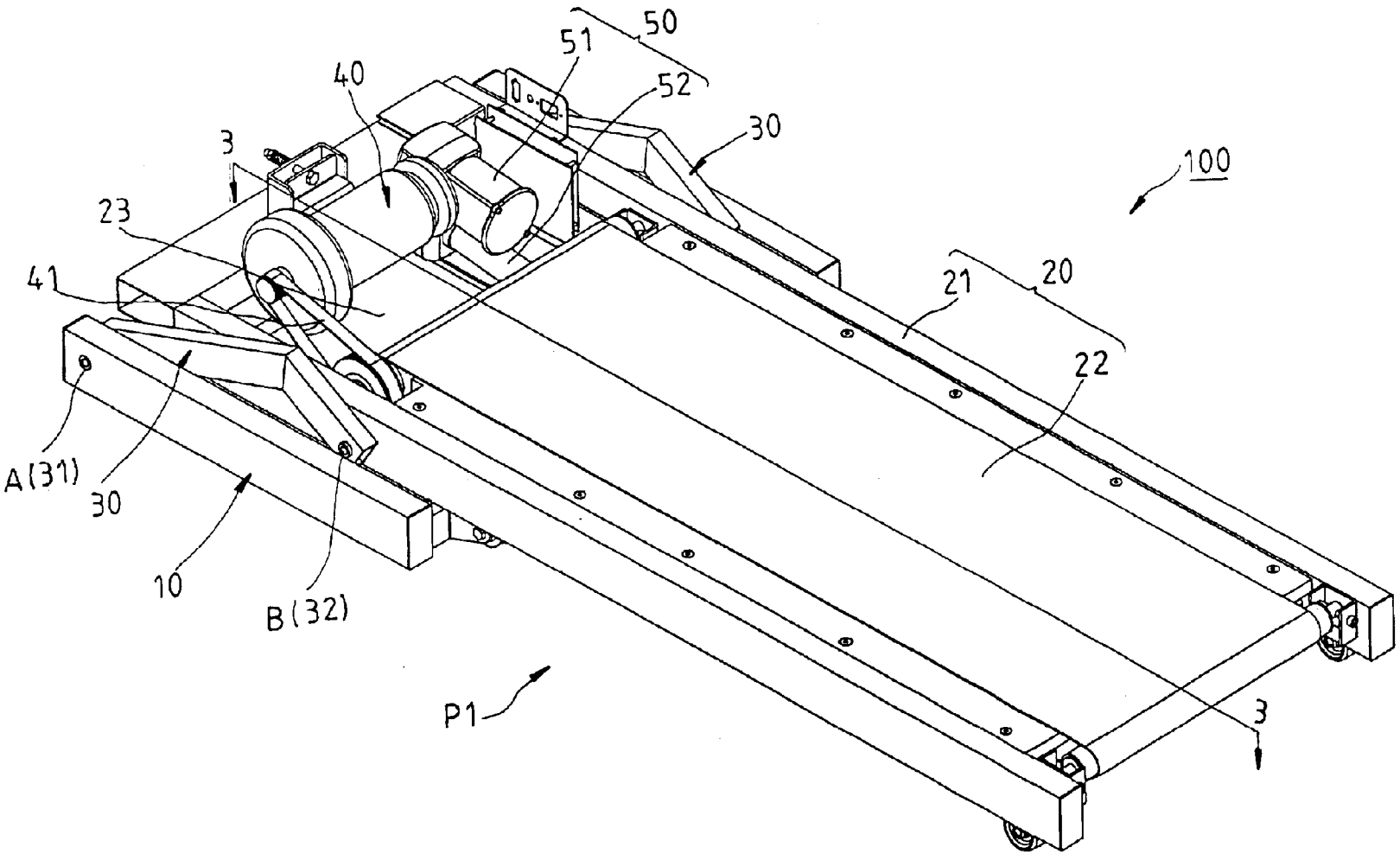
FIG. 2 is a perspective view of a lifting mechanism and treadmill arrangement according to a preferred embodiment of the present invention.
Figure 3:
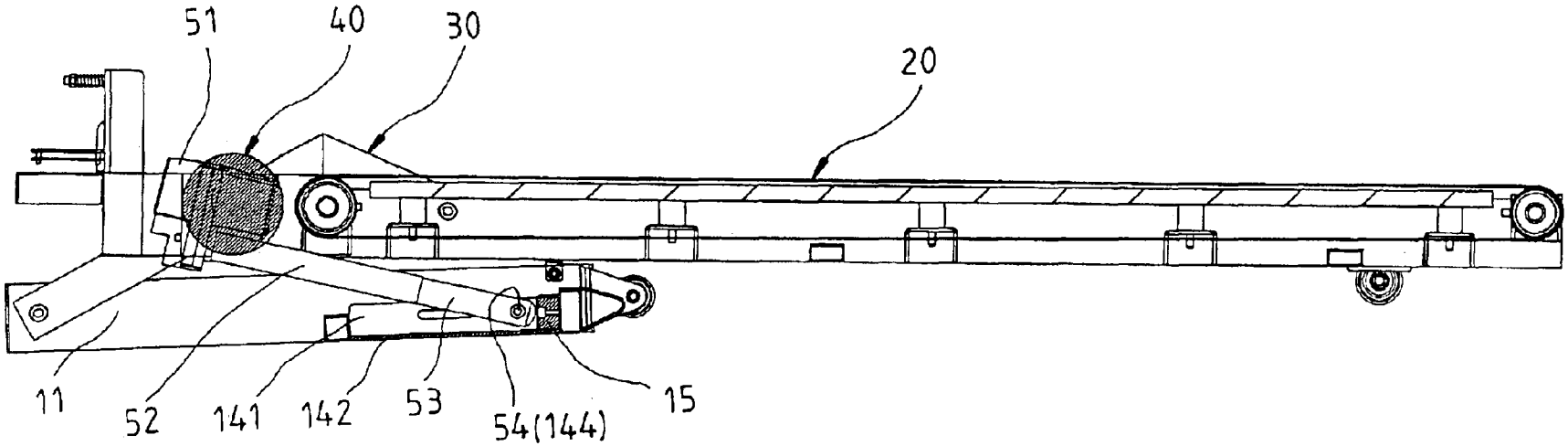
FIG. 3 is a sectional view taken along a line 3—3 of FIG. 2.
Figure 6:
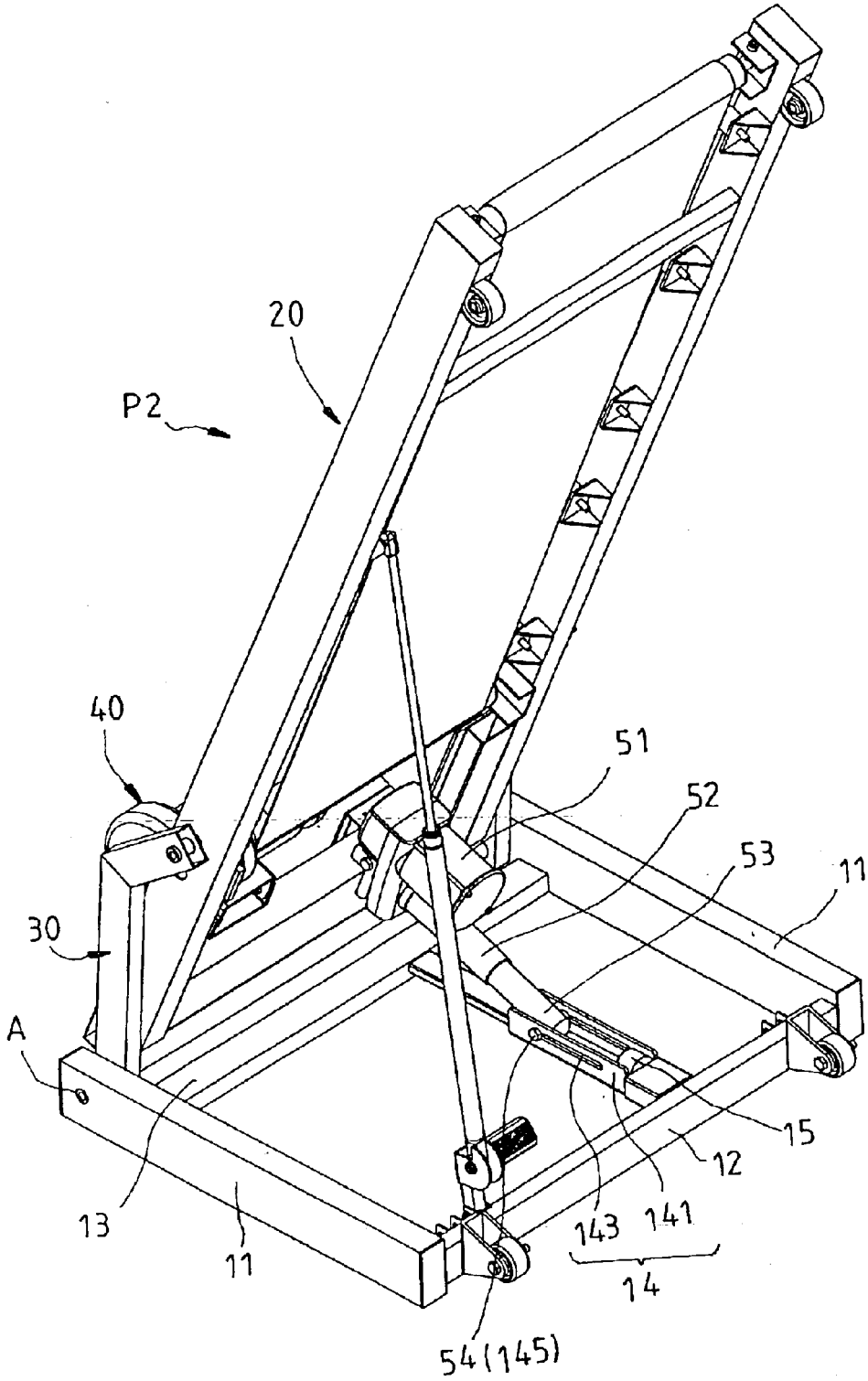
FIG. 6 is still another perspective view of the preferred embodiment of the present invention, showing that the treadbase of the present invention is received in the non-operative position.

Referring to FIGS. 2, 3, and 6, a lifting mechanism and treadmill arrangement 100 is composed of a base frame 10, a treadbase 20, two links 30, a treadbase motor 40, and a lifting mechanism 50.

The base frame 10 includes two parallel side bars 11, a transverse bar 12 connected between rear ends of the side bars 11, a supplementary bar 13 connected between front sections of the side bars 11, a guide member embodied as guide frame 14 connected between the transverse bar 12 and the supplementary bar 13 and arranged in parallel to the side bars 11, and a buffer block 15 provided in the guide frame 14. The guide frame 14 includes two vertical side plates 141 and a bottom plate 142. The side plates 141 each have a longitudinal sliding slot 143 defining a first dead point 144 and a second dead point 145. The buffer block 15 is fixedly mounted in the guide frame 14 adjacent to the first dead point 144.

The treadbase 20 includes a treadbase frame 21 and an endless belt 22. A receiving space 23 is defined between the treadbase frame 21 and a front side of the endless belt 22.

The two links 30 are bilaterally mounted near a front side of the treadbase frame 21, each having a first coupling end portion 31 and a second coupling end portion 32. The coupling end portion 31 is connected pivotally with a front end of the side bar 11 of the base frame 10, defining a respective pivot A. The second coupling end portion 32 is connected pivotally with the front side of the treadmill base 21, defining a respective pivot B. Accordingly, the treadbase 20 can be turned about the pivot A between an operative position P1 (see FIG. 2) and a non-operative position P2 (see FIG. 6).

The treadbase motor 40 is fixedly mounted in the receiving space 23 of the treadbase 20 and is controlled to rotate the endless belt 22 through a belt transmission mechanism 41.

The lifting mechanism 50 includes an inclining motor 51, an internally threaded barrel 52, a push member 53, and stop means embodied as a stop pin 54. The inclining motor 51 is mounted pivotally on the treadbase frame 21. The barrel 52 has an end fixedly mounted to the inclining motor 51. The push member 53 is a screw rod threaded into the barrel 52. The stop pin 54 runs through a transverse through hole (not shown) at a front end of the push member 53 outside the barrel 52, having two distal ends respectively inserted through the sliding slots 143 of the vertical side plates 141 of the guide frame 14 (see FIG. 6). When the inclining motor 51 is operated, the push member 53 is rotated in or out of the barrel 52, thereby causing the stop pin 54 to move along with the push member 53 between the first dead point 144 and the second dead point 145.

The control of the angle of inclination of the treadbase 20 is described hereinafter.

Figure 4:
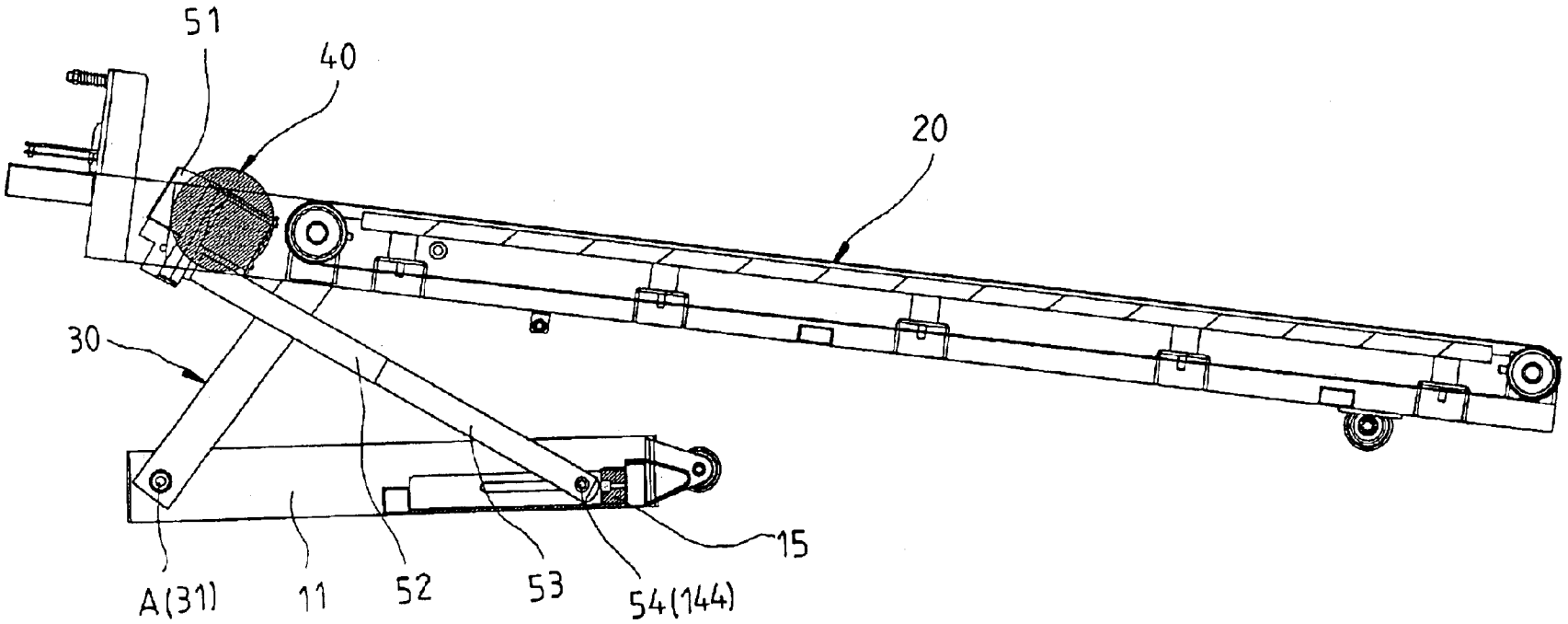
FIG. 4 is similar to FIG. 3, showing that a front side of a treadbase of the present invention is lifted.
Figure 5:
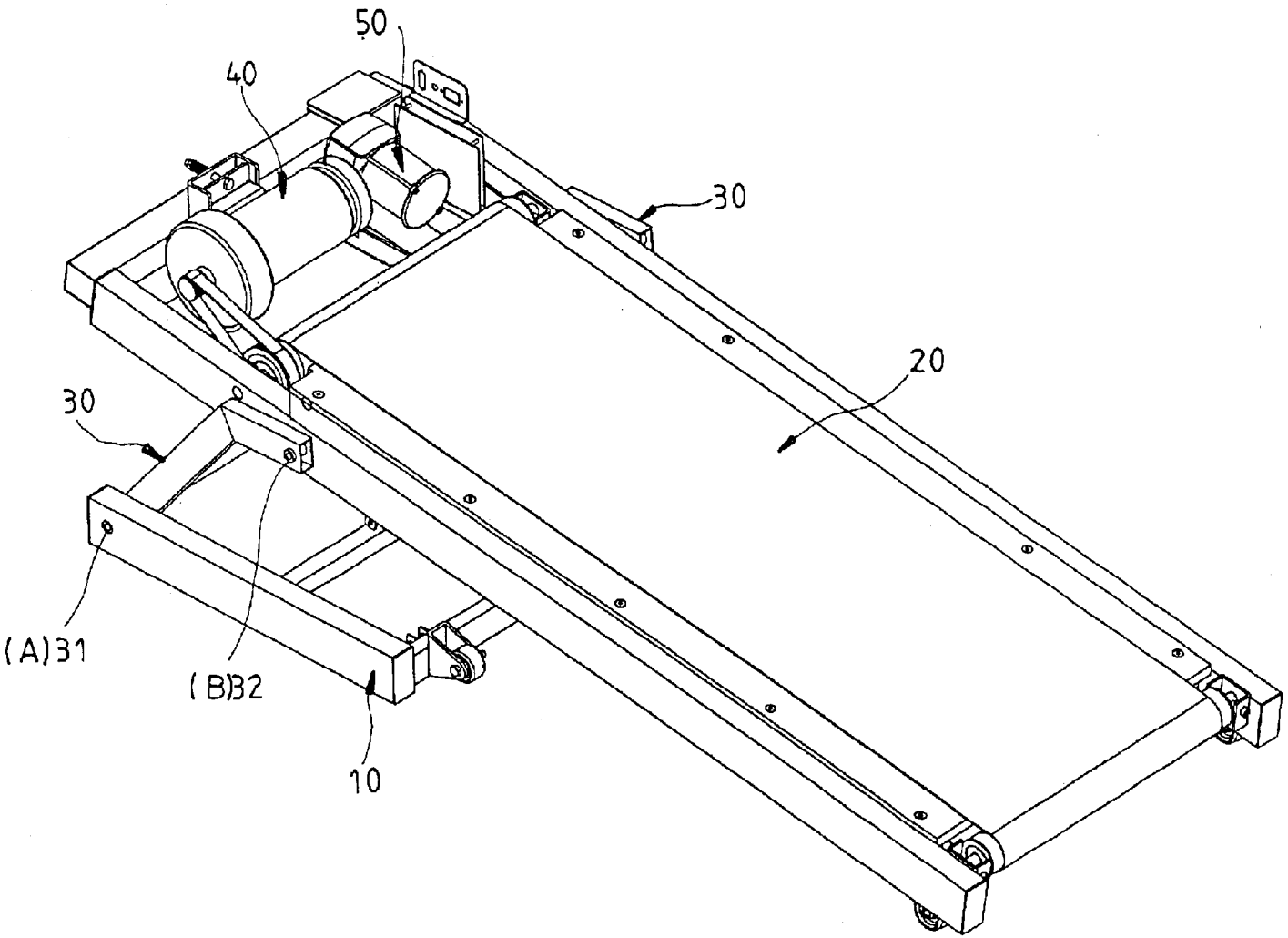
FIG. 5 is another perspective view of the preferred embodiment of the present invention, showing that the front side of the treadbase is lifted.

As illustrated in FIG. 3, when the treadbase 20 is positioned horizontally, the push member 53 is received in the barrel 52, the stop pin 54 is stopped at the first dead point 144 and the front end of the push member 53 is stopped against the buffer block 15. When the treadbase 20 is controlled to lift, as shown in FIG. 4, the inclining motor 51 is driven to rotate the push member 53 out of the barrel 52. Because the front end of the push member 53 is stopped against the buffer block 15 and the links 30 are coupled between the treadbase 20 and the base frame 10, the push member 53 is rotated out of the barrel 52 and the front side of the treadbase 20 is lifted to change its angle of inclination, as shown in FIG. 5.

When the treadbase 20 is turned to the non-operative position P2, the front side of the treadbase 20 is lowered to the position shown in FIG. 3 (where the push member 53 received in the barrel 52), and then a rear side of the treadbase 20 is lifted with hands. When turning the treadbase 20 about the pivots A to lift the rear side of the treadbase 20, the stop pin 54 is moved along the sliding slots 143 toward the second dead point 145, and at the same time the inclining motor 51 is rotated for enabling the treadbase 20 to be smoothly turned about the pivots A to the position shown in FIG. 6 where the stop pin 54 is stopped at the second dead point 145. Lock means may be used to lock the treadbase 20 in the non-operative position. Because the lock means can easily be obtained from known techniques and is not within the scope of the claims of the present invention, nor further detailed description in this regard is necessary.

According to the aforesaid description, the present invention has advantages as follows:

1. When the treadbase 20 is set horizontally, as shown in FIG. 2, the treadbase motor 40 and the inclining motor 51 are received in the receiving space 23 without interfering each other, i.e. the treadmill does not occupy much vertical storage space when set horizontally.

2. When the treadbase 20 is set in the operative position P1, the lifting mechanism 50 is held horizontally without hindering the front end of the treadbase 20.

3. The front side of the treadbase 20 is controlled to stably lift by means of the support of the lifting mechanism 50, the guide frame 14 of the base frame 10, and the links 30.

What is claimed is:

1. A treadmill comprising:

a base frame, positioned on the floor horizontally, having a guide member;

a treadbase formed of a treadbase frame and an endless belt;

two links bilaterally mounted on said treadbase frame, said links each having a first coupling end and a second coupling end, said first coupling end being mounted pivotally on a front end of said base to form a first pivot point, said second coupling end being mounted pivotally on a front end of said treadbase frame to form a second pivot point, said treadbase frame being turned about the first pivot point with respect to said base frame between an operative position and a non-operative position;

a treadbase motor fixedly mounted in a front side of said treadbase frame for driving said endless belt to rotate; and a lifting mechanism including a push member and an inclining motor, said push member having stop means at a front end thereof, said inclining motor being mounted pivotally on said treadbase frame to drive said stop means of said push member to move back and forth along said guide member of said base frame.

2. The treadmill as defined in claim 1, wherein said base frame includes two parallel side bars and a transverse bar connected between rear ends of said side bars; wherein said guide member is a frame and is fixedly mounted to said transverse bar and positioned parallel to said side bars, said guide frame including at least one sliding slot, said sliding slot extending parallel to said side bars and defining a first dead point and a second dead point at two ends thereof.

3. The treadmill as defined in claim 2, wherein said guide frame includes two vertical side plates and a bottom plate, said side plates each having said sliding slot; wherein said lifting mechanism further includes a barrel, and said push member is formed of a screw rod running into said barrel; wherein said treadbase motor drives said screw rod to screw in and out of said barrel, said screw rod having a through hole, said stop means having a stop pin running through the through hole, said stop pin having two ends respectively running through said sliding slots.

4. The treadmill as defined in claim 1, wherein said treadbase includes a receiving space defined between said treadbase frame and a front side of said endless belt for receiving said inclining motor while said treadbase is in said operative position.

5. The treadmill as defined in claim 3, wherein a buffer block is fixedly mounted between said vertical side plates and adjacent to said first dead point.

* * * * *